United States Patent [19]

Wearden et al.

[11] Patent Number: 4,532,104

[45] Date of Patent: Jul. 30, 1985

[54] TRANSPORT AND STORAGE FLASK FOR NUCLEAR FUEL

[75] Inventors: Sydney Wearden, Bold; John A. Gatley, Knutsford, both of England

[73] Assignee: British Nuclear Fuels Limited, Warrington, England

[21] Appl. No.: 361,210

[22] Filed: Mar. 24, 1982

[30] Foreign Application Priority Data

Apr. 6, 1981 [GB] United Kingdom ..... 8110642

[51] Int. Cl.[3] ..... G21F 5/00

[52] U.S. Cl. ..... 376/272; 250/506.1; 250/518.1

[58] Field of Search ..... 376/272; 250/506.1, 250/507.1, 518.1

[56] References Cited

U.S. PATENT DOCUMENTS

| | | | |
|---|---|---|---|
| 3,111,586 | 11/1963 | Rogers . | |
| 3,391,280 | 7/1968 | Bonilla et al. | 250/506.1 |
| 3,414,727 | 12/1968 | Bonilla | 250/506.1 |
| 3,610,334 | 10/1971 | Sletten | 250/506.1 |
| 3,619,616 | 11/1971 | Smith | 250/506.1 |
| 3,845,315 | 10/1974 | Blum | 250/507.1 |
| 3,886,368 | 5/1975 | Rollins et al. | 376/272 |
| 4,021,676 | 5/1977 | Duffy | 250/506.1 |
| 4,175,669 | 11/1979 | Housholder et al. | 250/506.1 |
| 4,229,316 | 10/1980 | Boatz et al. | 250/507.1 |
| 4,277,688 | 7/1981 | Yamamoto et al. | 250/506.1 |

FOREIGN PATENT DOCUMENTS

| | | | |
|---|---|---|---|
| 1257299 | 12/1967 | Fed. Rep. of Germany . | |
| 2801946 | 7/1979 | Fed. Rep. of Germany | 250/506.1 |
| 0148999 | 11/1979 | Japan | 250/506.1 |
| 1265290 | 3/1972 | United Kingdom | 250/506.1 |
| 1422018 | 1/1976 | United Kingdom . | |
| 2009657 | 6/1979 | United Kingdom | 250/506.1 |
| 2033287 | 5/1980 | United Kingdom | 376/272 |

*Primary Examiner*—Harvey E. Behrend

*Attorney, Agent, or Firm*—William R. Hinds

[57] ABSTRACT

A flask for the transport and storage of irradiated nuclear fuel comprises a hollow cylindrical container having cooling fins surrounded by a jacket of neutron shielding material. The jacket can be formed in two semi-cylindrical portions which are hinged together and held tight about the container. The jacket is spaced radially from the extremities of the cooling fins.

4 Claims, 2 Drawing Figures

TRANSPORT AND STORAGE FLASK FOR NUCLEAR FUEL

BACKGROUND OF THE INVENTION

The present invention concerns a container or flask for the transport and storage of nuclear fuel.

Flasks for irradiated nuclear fuel elements are required to be mechanically robust to withstand possible damage in transit and must safely contain the radioactivity of the nuclear fuel therein. To achieve this a flask is formed with thick walls having a required mechanical strength and which provide gamma shielding. In addition it is necessary to provide neutron shielding and to dissipate the heat generated by radioactive decay.

SUMMARY OF THE INVENTION

According to the present invention, a flask for the transport and storage of irradiated nuclear fuel comprises a hollow cylindrical container having an axis, cooling fins on the exterior of the container, the cooling fins being axially spaced apart along the axis and extending about the circumference of the container, an outer jacket of neutron shielding material substantially surrounding the fins, and spacers carried by the jacket in embracing contact with but unconnected to the exterior of the container and passing between axially adjacent cooling fins to support the jacket on the container and space the jacket radially from the extremities of the fins to provide a space for through-flow of air about the container and fins for cooling, the jacket being releasable and removable from the container as an integral unit, the jacket comprising at least two portions, there being a hinged interconnection at one pair of adjacent sides of the portions and an adjustable interconnection at another pair of adjacent sides of the portions.

The flask can be provided with means to support a sleeve which fits over the jacket of neutron absorbing material when the flask is to be immersed in a storage pond.

DESCRIPTION OF THE DRAWINGS

An embodiment of the invention will be described further, by way of example, with reference to the accompanying drawings; in which.

DESCRIPTION OF THE PREFERRED EMBODIMENT

Figure 1:
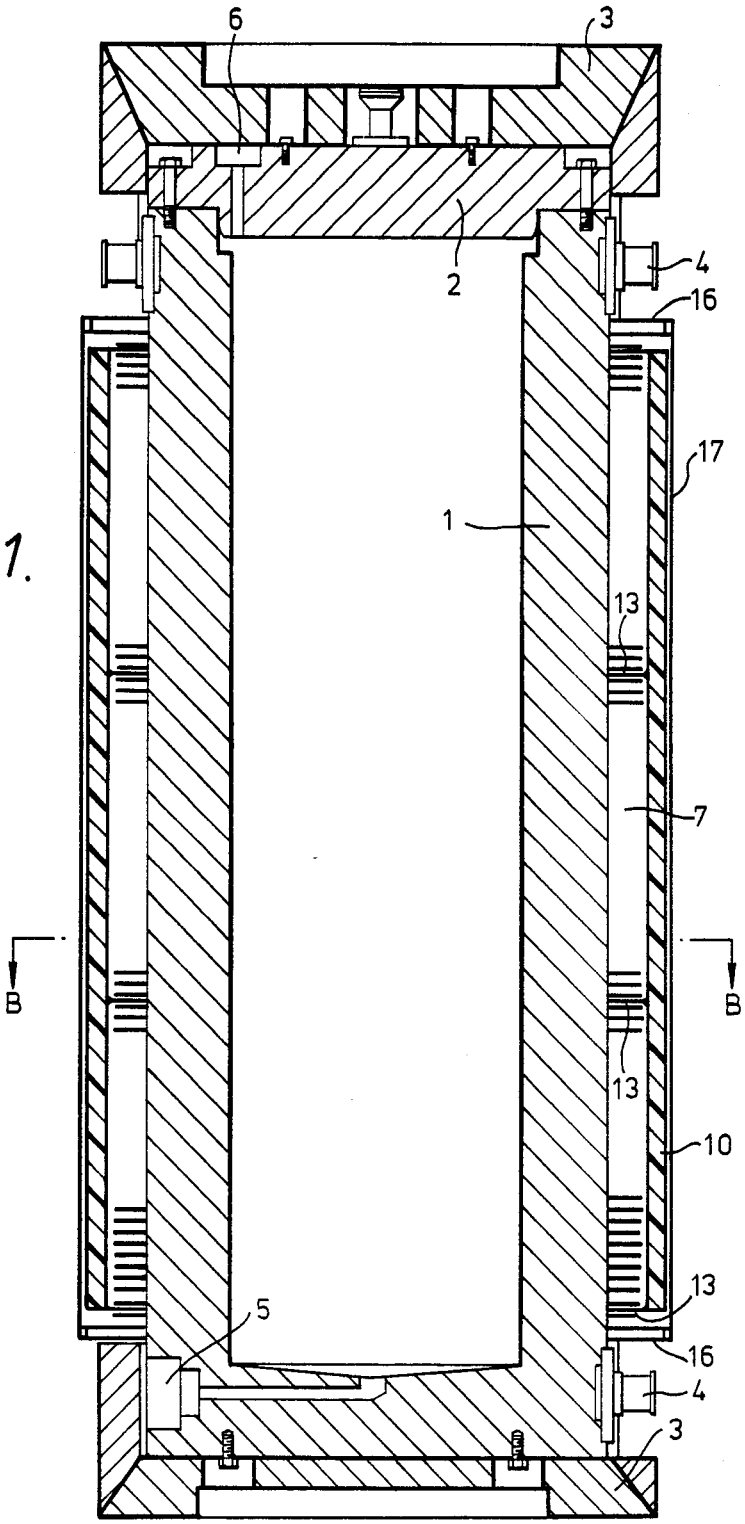
FIG. 1 is a sectional elevation of a flask for the transport and storage of irradiated nuclear fuel.

A hollow flask for receiving irradiated nuclear fuel comprises a cylindrical container 1, conveniently mild steel lined with stainless steel, and having a removable lid 2. Shock absorbers 3 are attached to the base and the lid of the container and trunnions 4 are provided at the ends of the container for use with lifting gear. Respective drain and vent valves 5 and 6 are provided in the base and the lid of the container, the former being shown 90° out of position in FIG. 1. The container is formed with peripheral cooling fins 7 for dissipating heat generated by radioactive decay of the fuel within the container.

Figure 2:
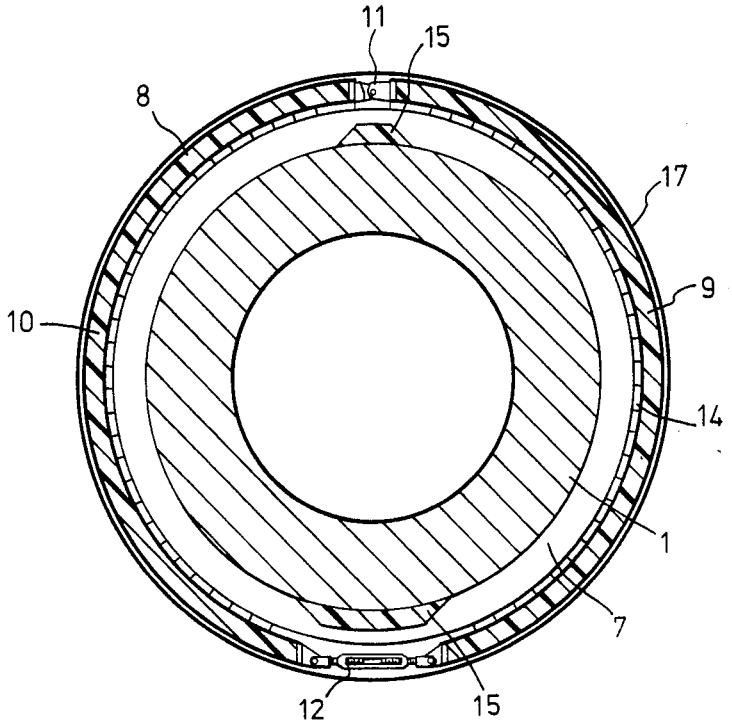
FIG. 2 is a section on B—B in FIG. 1.

Neutron shielding is arranged about the container outside the cooling fins 7. The neutron shielding comprises an annular cylindrical jacket conveniently formed in two semi-cylindrical portions 8 and 9 which fit about the container. The jacket contains a neutron shielding material 10 such as water expanded polystyrene. As shown in FIG. 2, the two jacket portions are connected together at one pair of adjacent longitudinal side edges by hinges 11 and are provided with adjustable toggles 12 at the other pair of adjacent longitudinal side edges whereby the jacket portions can be located about the flask and then closed tight to fit against the container and spaced from the cooling fins 7. The inner wall of each jacket portion is formed with spaced apart distance pieces 13 which contact the exterior of the container. The distance pieces 13 pass between adjacent cooling fins and are longer than the fins whereby each jacket portion is spaced from the outer ends of the fins. A plurality of equi-spaced slots 14 are formed in each distance piece 13 adjacent the internal wall of each jacket portion.

The walls of the container attenuate gamma radiation and cooling air can circulate about the fins 7 within the jacket. As shown in FIG. 2, the container is provided with neutron shielding material 15 at positions opposite the gaps in the jacket formed by the hinges and toggles.

The ends of the container are provided with bagging rings 16 each terminating in a seal which co-operates with a cylindrical sleeve 17 slidably received on the bagging rings. Such a sleeve is located about the jacket of neutron absorbing material when the flask is to be immersed in a pond at a storage site.

In use for the transport of irradiated nuclear fuel the flask is normally in a horizontal orientation and the sleeve 17 is omitted. In this orientation, cooling air can enter and leave the interior of the jacket through the gaps at the hinges and toggles, the flask being arranged such that such gaps are at the top and bottom of the flask as in FIG. 2. With the flask vertical, and again with the sleeve 17 omitted, cooling air can be convected upwardly within the jacket as a result of the spacing between the fins and the jacket together with the slots in the distance pieces.

We claim:

1. A flask for the transport and storage of irradiated nuclear fuel comprising a hollow cylindrical container having an axis, cooling fins on the exterior of the container, said cooling fins being axially spaced apart along said axis and extending about the circumference of the container, an outer jacket of neutron shielding material substantially surrounding the fins, and spacers carried by the jacket in embracing contact with but unconnected to the exterior of the container and passing between axially adjacent cooling fins to support the jacket on the container and space the jacket radially from the extremities of the fins to provide a space for through-flow of air about the container and fins for cooling, said jacket being releasable and removable from said container as an integral unit, said jacket comprising at least two portions, there being a hinged interconnection at one pair of adjacent sides of said portions and an adjustable interconnection at another pair of adjacent sides of said portions.

2. A flask according to claim 1 in which the jacket comprises two semi-cylindrical portions, the portions being hingedly interconnected at one pair of adjacent sides and adjustably interconnected at the other pair of adjacent sides.

3. A flask according to claim 1 including spaced apart slots in each spacer located at positions adjacent the jacket.

4. A flask for the transport and storage of irradiated nuclear fuel comprising a hollow cylindrical container having an axis, cooling fins on the exterior of the container, said cooling fins being axially spaced apart along said axis and extending about the circumference of the container, an outer jacket of neutron shielding material substantially surrounding the fins, and spacers carried by the jacket in embracing contact with but unconnected to the exterior of the container and passing between axially adjacent cooling fins to support the jacket on the container and space the jacket radially from the extremities of the fins to provide a space between the container and the jacket for through-flow of air about the container and fins for cooling when said space is not sealed from the atmosphere, said jacket being releasable and removable from said container as an integral unit, said jacket comprising at least two portions, there being a hinged interconnection at one pair of adjacent sides of said portions and an adjustable interconnection at another pair of adjacent sides of said portions, a sleeve for location on the container about the jacket for sealing said space between the container and the jacket, and means removably and releasably locating said sleeve on the container about the jacket to seal said space.

* * * * *